United States Patent [19]

Maresh

[11] 4,031,560

[45] June 21, 1977

[54] CHOPPED LIGHT RELAY KEYER

[76] Inventor: Richard L. Maresh, R.R. No. 2, Syracuse, Ind. 46567

[22] Filed: Nov. 19, 1975

[21] Appl. No.: 633,294

[52] U.S. Cl. ..... 361/175; 250/559; 307/117; 352/155; 352/174; 361/156

[51] Int. Cl.² ..... H01H 47/24

[58] Field of Search ..... 317/124, 125, 141 R, 317/141 S, 147, 151, DIG. 1; 307/117, 233 R, 233 A; 352/155, 174, 176, 177; 340/259, 260; 250/559, 561; 242/36, 37 R, 57, 186, 191

[56] References Cited

UNITED STATES PATENTS

| | | | |
|---|---|---|---|
| 2,351,229 | 6/1944 | Potts | 340/259 |
| 3,252,141 | 5/1966 | Galin | 317/141 S X |
| 3,551,039 | 12/1970 | Hewitt | 352/155 X |
| 3,801,031 | 4/1974 | Kamp et al. | 242/36 |

*Primary Examiner*—Harry E. Moose, Jr.

[57] ABSTRACT

A phototransistor is coupled to a relay coil and the base of a switching transistor. Light impinging on the phototransistor will cause it to conduct, switching on the transistor causing current flow in the relay coil. Fluctuating light intensity on the phototransistor will cause a corresponding fluctuation of current in the relay coil. A predetermined level of current in the coil will maintain the relay closed.

10 Claims, 2 Drawing Figures

CHOPPED LIGHT RELAY KEYER

BACKGROUND OF THE INVENTION

1. Field of the Invention

This invention is in the field of protective circuits for disabling system operation upon a malfunction, and in particular, to disable a movie projector substantially immediately upon cessation of film movement.

2. Description of the Prior Art

Devices have been proposed to stop the mechanical and/or electrical components of a film project upon film movement failure in order to prevent further damage to the film and to locate accurately the cause of failure. However, such devices are unreliable and involve substantial time lag between the time of failure and the time the electrical and mechanical components are disabled, causing possible film damage and making the failure cause difficult to detect.

SUMMARY OF THE INVENTION

A phototransistor is placed in the path of an intermittent or chopped light source. The projected light from a properly operating movie projector would appear as such a source. The base of a switching transistor ir coupled to the collector-emitter circuit of the phototransistor and is switched on and off at the frequency of the chopped light impinging thereon. A relay coil is coupled in the emitter-collector circuit of the switching transistor and is provided with a predetermined level of current when the switching transistor is operating at the switching frequency. When the coil is provided with the predetermined current level, it generates sufficient flux to hold in its contacts and continue operation of an external circuit. The moment the switching frequency falls below that which is necessary to provide current to hold in the relay contacts, the external circuit is opened. Therefore, in the case of a movie projector, if the film stops, the intermittent light flashes impinging on the phototransistor stop, the switching transistor is not switched, and there is no current in the relay coil. This all takes place in a fraction of a second. There is an adjustment between the base of the switching transistor and the photosensitive transistor for regulating the time lag between failure and relay opening.

It is an object of this invention to provide a protective circuit that monitors an intermittent light source and is immediately responsive to a predetermined change in the intermittency of the source to provide a protective signal.

It is another object to provide in the device of the foregoing object an adjustment of the magnitude and response time of the protective signal strength and lag time between the predetermined change and the provision of the protective signal.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
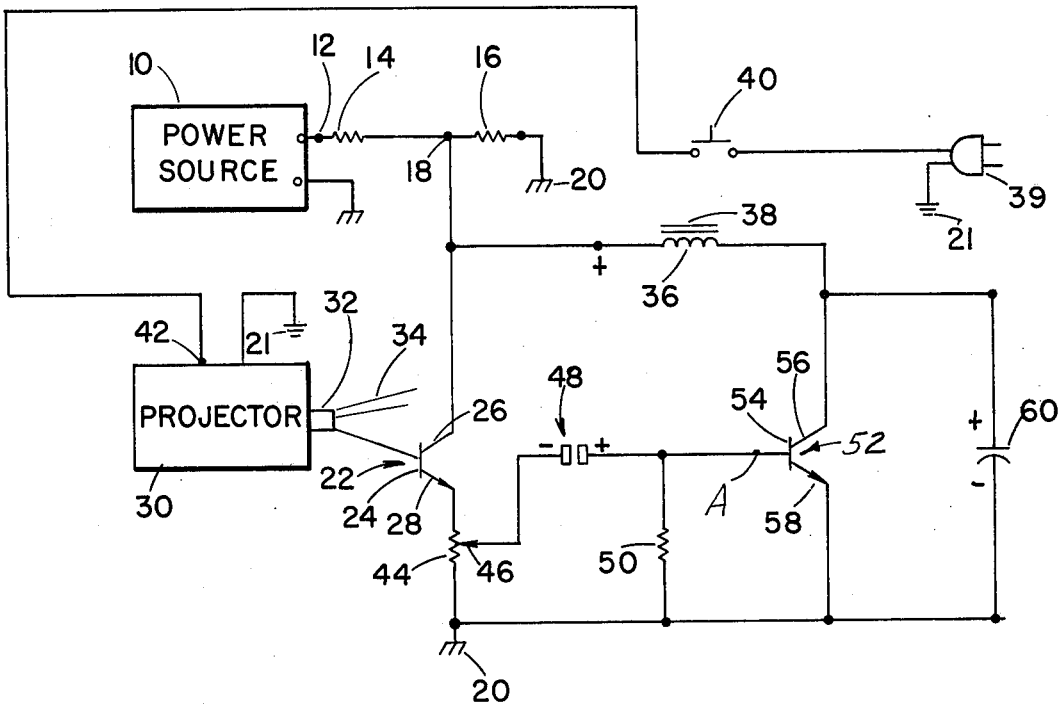
FIG. 1 is a schematic diagram of a preferred embodiment of this invention.

A power source 10 supplies a 23 to 25 DC voltage at output terminal 12. A voltage divider has resistance 14 and resistance 16 which are connected at junction 18. Resistance 16 is connected to chassis ground 20. Phototransistor 22 has base 24, collector 26 and emitter 28. Projector 30 has lense 32 oriented so that a portion of the projected light image 34 inpinges upon base 24. Projector 30 may be a conventional movie projector which typically project images from a movie film, not shown, at the rate of 25 – 30 frames per second. This results in an intermittent, or chopped, light intensity output in projected light 34 of 25 – 30 cycles per second.

Impingement of light 34 upon base 24 above a certain intensity level causes transistor 22 to conduct. Collector 26 is connected to junction 18 and to one terminal of relay coil 36. Current flow in coil 36 causes flux generation in core 38 which will hold in relay contact 40, closing the power circuit between plug 39 and input terminal 42 of projector 30. Plug 39 is adapted for insertion in a conventional wall socket having 120 volt AC power, not shown.

Emitter 28 is connected to one terminal of potentiometer 44 which is connected to chassis ground 20 at its other terminal. Slide 46 of potentiometer 44 is connected to one plate of differentiating capacitor 48, the other plate of capacitor 48 being connected to time constant resistor 50 and base 54 of switching transistor 52. Collector 56 of transistor 52 is connected to the other terminal of relay coil 36 and to one plate of filter capacitor 60, the other plate of which is connected to chassis ground 20. Emitter 58 of transistor 52 is connected to ground 20.

Figure 2:
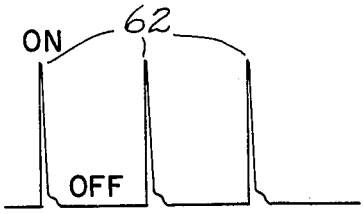
FIG. 2 is a curve showing a time-voltage waveform taken at point A of FIG. 1, time being plotted along the abscissa and voltage being plotted along the ordinate.

In operation, projector 30 emits a projected field 34 having a fluctuating light intensity corresponding to the frame rate and shutter frequency of the projector. The intermittent or chopped light in field 34 impinges upon base 24 of phototransistor 22 causing it to conduct at a frequency corresponding to the intermittency rate in field 34. Slide 46 is positioned on resistor 44 and places a voltage across capacitor 48 corresponding to the slide position. The higher the slide position, the greater the voltage applied across capacitor 48. During normal operation of the projector, the voltage form at point A is shown in FIG. 2 where it is seen then for each frame and shutter closing of projector 30, a spike 62 is generated. Each spike 62 causes transistor 52 to momentarily conduct thereby discharging the upper plate of capacitor 60 and providing a current path through coil 36 between juction 18 and ground 20. Between spikes 62, transistor 52 is turned off but current flow still takes place through coil 36 charging the upper plate of capacitor 60. However, before the capacitor 60 becomes fully charged, the second spike 62 occurs discharging capacitor 60 and repeating the previous sequence. During normal operation of projector 30, the spikes 62 occur at a sufficiently frequent rate so that there is sufficient current flow through coil 36 to maintain relay contacts 40 closed.

However, upon a malfunction in projector 30, such as film breakage, faulty shutter operation, or the like, the projected field 34 will no longer have a fluctuating light intensity at the normal shutter frequency, i.e., field 34 will be constantly dark, or of constant light intensity. If the field 34 is constantly dark, there will be no photo-energy input to base 24 and transistor 22 will be off. Spikes 62 will not be generated across capacitor 48, transistor 52 therefore remaining off. Capacitor 60 will begin to charge through coil 36 and when fully charged, current will cease in coil 36 opening relay contacts 40 and disconnecting power to input terminal 42 of projector 30. On the other hand, if the projected field 34 is of a constant light intensity to energize base 24 and maintain transistor 22 on, spikes 62 likewise will not be generated across capacitor 48 and transistor 52 will remain off resulting in the opening of relay contacts 40 as hereinbefore described for the dark condition.

The time delay between the constant on condition or constant off condition of transistor 22 and the opening of switch 40 can be varied by varying the position of slide 46 on potentiometer 44. The higher the slide 46 on the resistor of potentiometer 44, the greater the voltage and charge on capacitor 48 and the longer it will take to discharge through resistor 50 to ground 20. The longer the discharge time, the longer it will take to turn transistor 52 off and the longer it will be before capacitor 60 becomes fully charged, thus diminishing the current flow through coil 36 and opening switch 40.

When slide 46 is at its uppermost position on potentiometer 44, there will be an 8 millisecond delay between projector malfunction and circuit interruption and when slide 46 is in its lowermost position on resistor 44 there will be a delay of 0 milliseconds between pojector malfunction and circuit interruption.

Following are listed values of the various components of a working embodiment of this invention, these values being given as exemplary only and not to be considered as limitative of the invention.

Resistors

14: 75 ohms; 5 watt
16: 120 ohms; 5 watt
44: 2.2 kilohms
50: 2.2 kilohms Capacitors

48: 1 microfarad
60: 470 microfarads

Transistors

22: Fairchild FPT 100 high speed phototransistor
52: Motorola HEP 54

Relay

38: 12 VDC relay

While there have been described above the principles of this invention in connection with specific apparatus, it is to be clearly understood that this description is made only by way of example and not as a limitation to the scope of the invention.

What is claimed is:

1. A protective circuit for an intermittent light energy source comprising: first means for emitting electrical energy in response to said intermittent light energy; and second means for controlling the operation of said source in response to the electrial energy emission of said first means; third means for adjusting the response time of said second means to the emission from said first means.

2. The protective circuit according to claim 1, wherein said second means comprises a transistor having a base, collector, and emitter; said first means being coupled to said base so that light impingement on said first means will cause an electrical energy emission applied to the base of said transistor causing said transistor to conduct.

3. The protective circuit according to claim 2 wherein said second means further comprises an emitter-collector circuit relay means coupled in the emitter and collector circuit; said relay means being actuated in response to conduction of said transistor.

4. The protective circuit of claim 3 wherein said first means comprises a phototransistor having a base, collector and emitter: said first named transistor base being coupled to one of said phototransistor emitter and collector so that light impingement on the phototransistor base will cause energy emission to said transistor base.

5. The protective circuit according to claim 4 wherein said third means comprises a potentiometer coupled to said one phototransistor emitter and collector and having a slide element; differentiating means; said slide being coupled through said differentiating means to said transistor base so that upon light impingement on said phototransistor base a spike voltage is applied to said transistor base corresponding to the position of said slide on said resistor.

6. The protective circuit according to claim 5 wherein said relay means is coupled between said phototransistor collector and said transistor collector, and said potentiometer is coupled to said phototransistor emitter.

7. The protective circuit of claim 5 wherein said differentiating means comprises a capacitor coupled between said slide and said transistor base and a resistor coupled across said transistor base and said transistor emitter.

8. The protective circuit according to claim 7 including a filter capacitor coupled across said transistor collector and emitter.

9. A protective circuit for a projector having a sequentially framed light energy output comprising a phototransistor having a base, collector, and emitter; said base being subject to the output of the projector and being biased thereby to cause conduction between said emitter and said collector at a rate corresponding to said sequential frame occurence; a transistor having a base, collector, and emitter; a transistor emitter-collector circuit; a relay coil being coupled in said transistor emitter collector circuit; a capacitor being coupled across said transistor emitter and collector; a power source being coupled across said relay and capacitor whereby said power source will charge said capacitor through said relay when said transistor is non-conductive; a differentiating circuit being coupled between said phototransistor emitter and said transistor base whereby a spike signal will be generated and applied to said transistor base when said phototransistor conducts; a power circuit for applying power to the projector; a relay contact switch in said power circuit responsive to current flow in said relay coil to close said power circuit to said projector and responsive to attenuated current flow in said relay coil to open the power circuit to power projector.

10. The apparatus of claim 9 including a potentiometer coupling the phototransistor emitter and said differentiating circuit whereby the response time between interruption of the projector sequential framing and the relay coil current attenuation is adjustable.

* * * * *